US009039451B2

(12) United States Patent
Huang

(10) Patent No.: US 9,039,451 B2
(45) Date of Patent: May 26, 2015

(54) POWER DEVICE AND PLUG STRUCTURE THEREOF

(71) Applicant: DELTA ELECTRONICS, INC., Taoyuan County (TW)

(72) Inventor: Chin-Chu Huang, Taoyuan County (TW)

(73) Assignee: DELTA ELECTRONICS, INC. (TW)

( * ) Notice: Subject to any disclaimer, the term of this patent is extended or adjusted under 35 U.S.C. 154(b) by 106 days.

(21) Appl. No.: 13/912,742

(22) Filed: Jun. 7, 2013

(65) Prior Publication Data

US 2014/0199889 A1 Jul. 17, 2014

(30) Foreign Application Priority Data

Jan. 16, 2013 (TW) ..... 102101575 A

(51) Int. Cl.
*H01R 13/66* (2006.01)
*H01R 31/06* (2006.01)
*H01R 103/00* (2006.01)

(52) U.S. Cl.
CPC ..... *H01R 13/6691* (2013.01); *H01R 2103/00* (2013.01); *H01R 31/065* (2013.01)

(58) Field of Classification Search
USPC ..... 439/620.2–620.22, 676, 188, 824, 346
See application file for complete search history.

(56) References Cited

U.S. PATENT DOCUMENTS

| | | | | |
|---|---|---|---|---|
| 3,689,871 | A | 9/1972 | Hoegerl | |
| 6,064,509 | A | 5/2000 | Tonar et al. | |
| 7,651,365 | B2 | 1/2010 | Chien | |
| 7,717,749 | B2 * | 5/2010 | Chen et al. | 439/620.22 |
| 7,980,882 | B2 * | 7/2011 | Hetzer et al. | 439/404 |
| 8,105,100 | B1 | 1/2012 | Cheng | |
| 8,210,878 | B2 * | 7/2012 | Shirai et al. | 439/620.21 |
| 2008/0064248 | A1 * | 3/2008 | Huang | 439/346 |
| 2009/0110876 | A1 * | 4/2009 | Chang | 428/119 |
| 2010/0317209 | A1 * | 12/2010 | Huang | 439/140 |
| 2012/0135647 | A1 * | 5/2012 | Yu et al. | 439/824 |
| 2012/0171902 | A1 | 7/2012 | Lee | |

OTHER PUBLICATIONS

European Search Report dated Feb. 6, 2014 from corresponding application No. EP 13170916.4.

* cited by examiner

*Primary Examiner* — Jean F Duverne
(74) *Attorney, Agent, or Firm* — Lowe Hauptman & Ham, LLP

(57) ABSTRACT

In a power device and a plug structure, the plug structure includes an electrical conductor, a pin and a conductive elastic sheet. The pin is correspondingly arranged to the electrical conductor. The pin has a conducting portion and a distal end formed on the conducting portion. The conductive elastic sheet has a lateral segment and at least one longitudinal segment extending from the lateral segment. The lateral segment has a first convex portion and a second convex portion reversed from each other. The longitudinal segment has a third convex portion. The lateral segment is clamped between the distal end and the electrical conductor, the first convex portion contacts the electrical conductor, the second convex portion grasps and contacts the distal end, and the third convex portion contacts the conducting portion.

20 Claims, 7 Drawing Sheets

POWER DEVICE AND PLUG STRUCTURE THEREOF

BACKGROUND OF THE INVENTION

1. Field of the Invention

The present invention relates to a power device, in particular, to a power device and a plug structure thereof.

2. Description of Prior Art

Followed with the development of electronic technology, people extremely require electronic products for learning and working in daily life. However, these electronic products usually need a power device for power supplying or charging. This power device has a main body including a transformer structure or a circuit board. The main body has a plug fixed thereon. The plug can be inserted in a socket with complied specification, so as to drain power for operation of the electronic products.

A traditional power device includes a fixed plug or a replaceable plug. Its plug generally includes a housing, a plurality of pins and a plurality of conductive sheets. The pin is fixed and partially exposed to the housing. The conductive sheet is connected to the pin via welding or riveting method. Accordingly, when the plug is connected to the main body of the power device, the conductive sheet can be electrically connected to the transformer structure or the circuit board. For example, U.S. Pat. No. 7,651,365 discloses a plug structure, which connects the pin and the conductive sheet with each other via the riveting method.

However, the riveting process has the following disadvantages. Its riveting size and combination resistance value are hard to control, such that plastic injection process is difficult. Further, the welding process has the following disadvantages. Its welding space and wire space requirement are greater, and the tin-feeding quality varies a lot. Therefore, when the combination of the pin and the conductive sheet is performed via riveting or welding, the process is complicated, and cost and quality are not satisfied. Moreover, when circuits or electronic elements in the power device damage and need to be repaired, it has to break the welding and the riveting between the pin and the conductive sheet, such that it increase labors and work times during maintenance process.

In view of this, it is an improved target for endeavor of Applicant to solve the above-mentioned problems of the prior art by hard research and application of doctrines.

SUMMARY OF THE INVENTION

The present invention is to provide a power device and a plug structure thereof, which uses a conductive elastic sheet to provide a plurality of convex portions for contacting a pin and an electrical conductor, so as to delete the riveting or welding process and further achieve advantages of simple assembly, low cost, perfect quality and convenience maintenance.

Accordingly, the present invention provides a plug structure, comprising:

an electrical conductor;

a pin correspondingly arranged to the electrical conductor, having a conducting portion and a distal end formed on the conducting portion; and a conductive elastic sheet disposed between the pin and the electrical conductor, the conductive elastic sheet having a lateral segment and at least one longitudinal segment extending from the lateral segment, the lateral segment having a first convex portion and a second convex portion reversed from each other, the longitudinal segment having a third convex portion;

wherein, the lateral segment is clamped between the distal end and the electrical conductor, the first convex portion contacts the electrical conductor, the second convex portion contacts the distal end, and the third convex portion contacts the conducting portion.

Accordingly, the present invention provides a power device, comprising:

a main body including a housing and a circuit board accommodating in an inside of the housing; and a plug structure connected to the housing, the plug structure including:

an electrical conductor;

a pin correspondingly arranged to the electrical conductor, having a conducting portion and a distal end formed on the conducting portion; and a conductive elastic sheet disposed between the pin and the electrical conductor, the conductive elastic sheet having a lateral segment and at least one longitudinal segment extending from the lateral segment, the lateral segment having a first convex portion and a second convex portion reversed from each other, the longitudinal segment having a third convex portion;

wherein, the lateral segment is clamped between the distal end and the electrical conductor, the first convex portion contacts the electrical conductor, the second convex portion contacts the distal end, and the third convex portion contacts the conducting portion.

The present invention further provides the following effects:

First, the present invention disposes the conductive elastic sheet between the pin and the electrical conductor so as to form electrically connection between the pin and the electrical conductor. Because the conductive elastic sheet provides a plurality of convex portions for contacting the pin and the electrical conductor, so as to delete the riveting or welding process, such that defective products can be avoid by reducing variation of riveting size or tin-feeding quality during the riveting or welding process. Further, it can solve the problem of inconvenient assembly of the riveting or welding portion of the plug structure, so as to achieve simple assembly, low cost, perfect quality and convenience maintenance.

Second, the first convex portion bends between the longitudinal segments and forms a first opening with a first angle towards the pin. The second convex portion bends on the lateral segment and forms a second opening with a second angle towards the electrical conductor. The third convex portion bends on the longitudinal segment and forms a third opening with a third angle towards the pin. Accordingly, the convex portion formed on the conductive elastic sheet has flexibility, such that in response to the difference of the size or the location of various types of pins, the convex portion can be deformed to contact the pin. Therefore, the conductive elastic sheet of the present invention has a wild range of well assembly performance, so as to render the convenient assembly of the plug structure.

Third, there are two longitudinal segments. The two longitudinal segments are formed on two ends of the lateral segment, respectively. The conductive elastic sheet grasps the conducting portion via the two third convex portions, such that the conductive elastic sheet forms a u-shaped grasping sheet so as to be grasped in the pin. Therefore, the conductive elastic sheet can be grasped in the pin by itself without external force, so as to improve the assembly stability of the plug structure.

Fourth, the present invention uses the assembly of the main body and the plug structure so as to construct the power device, so as to apply the advantages of the conductive elastic sheet either on the plug structure or the power device.

Fifth, the plug structure is a replaceable plug 5, such that the power device can further change different types of pins, so as to be use in sockets in different countries.

Sixth, a sliding block protrudes from an external periphery of a plug base of a replaceable plug. A u-locking block extends from the housing, such that the plug base slides in an inside of the u-shaped locking block via the sliding block. And, the plug base is locked and limited in the u-shaped locking block via the sliding block, so as to render the convenient connection of the replaceable plug and the main body.

Seventh, there are three conducting points between the conductive elastic sheet and the conducting portion, such that the electrical conductor and the pin achieve electrical connection via the conducting point. Specifically, the second convex portion and the two third convex portions contact the conducting portion so as to form the conducting point, such that more conducting points are formed between the electrical conductor and the pin for further improve conducting stability of the plug structure.

DETAILED DESCRIPTION OF THE INVENTION

Figure 1:
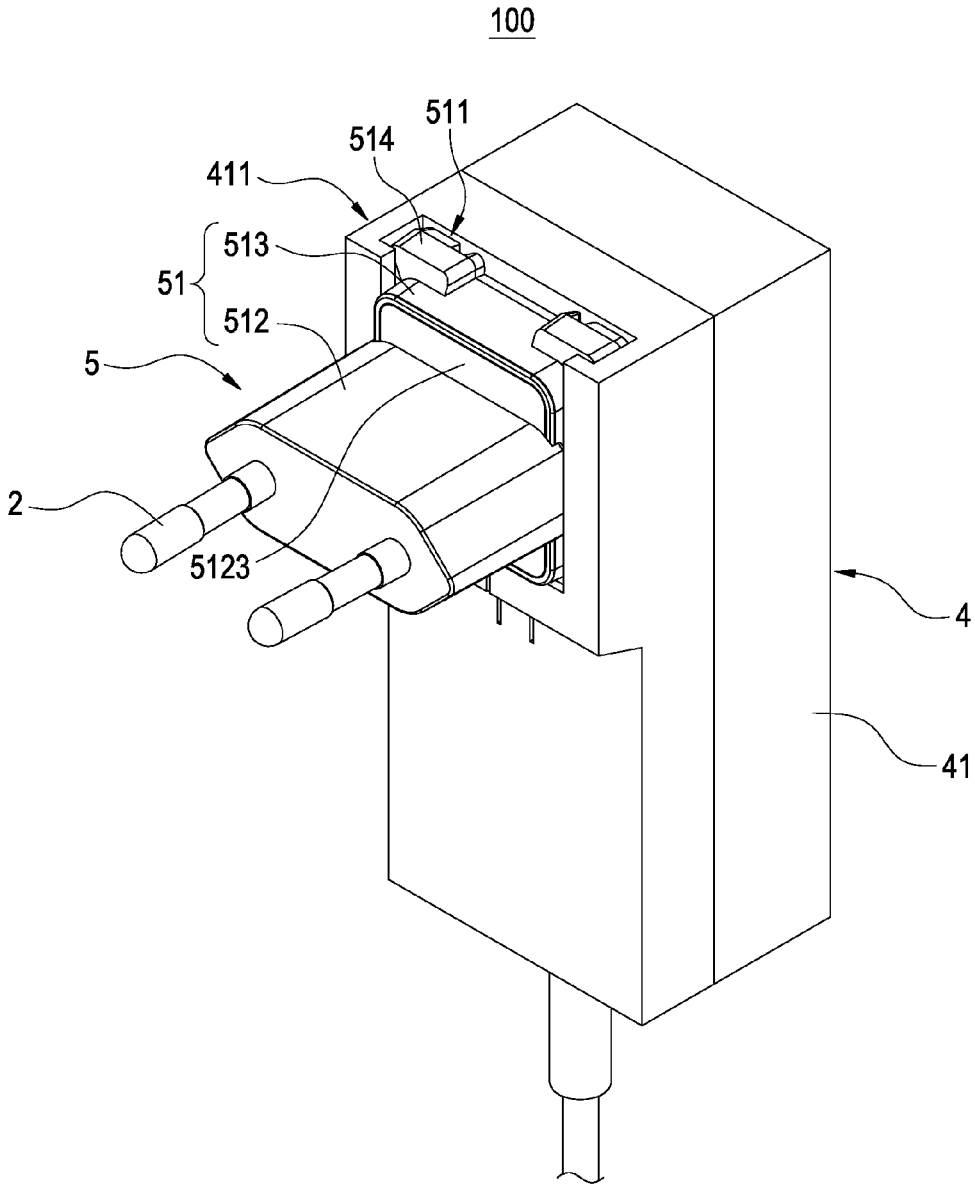
FIG. 1 is a perspective assembly view illustrating a power device according to a first embodiment of the present invention.
Figure 2:
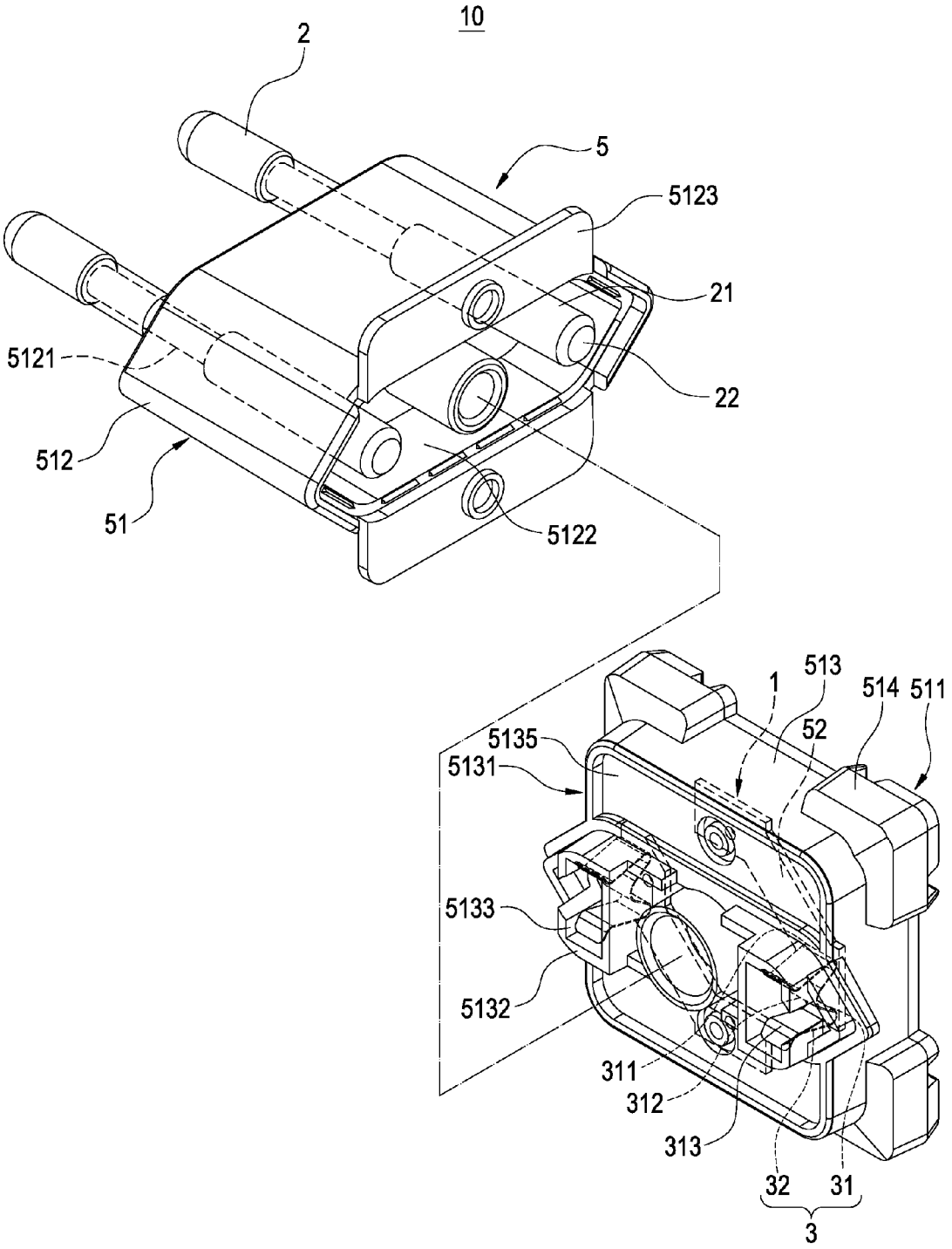
FIG. 2 is a perspective explosion view illustrating a plug structure according to the first embodiment of the present invention.
Figure 3:
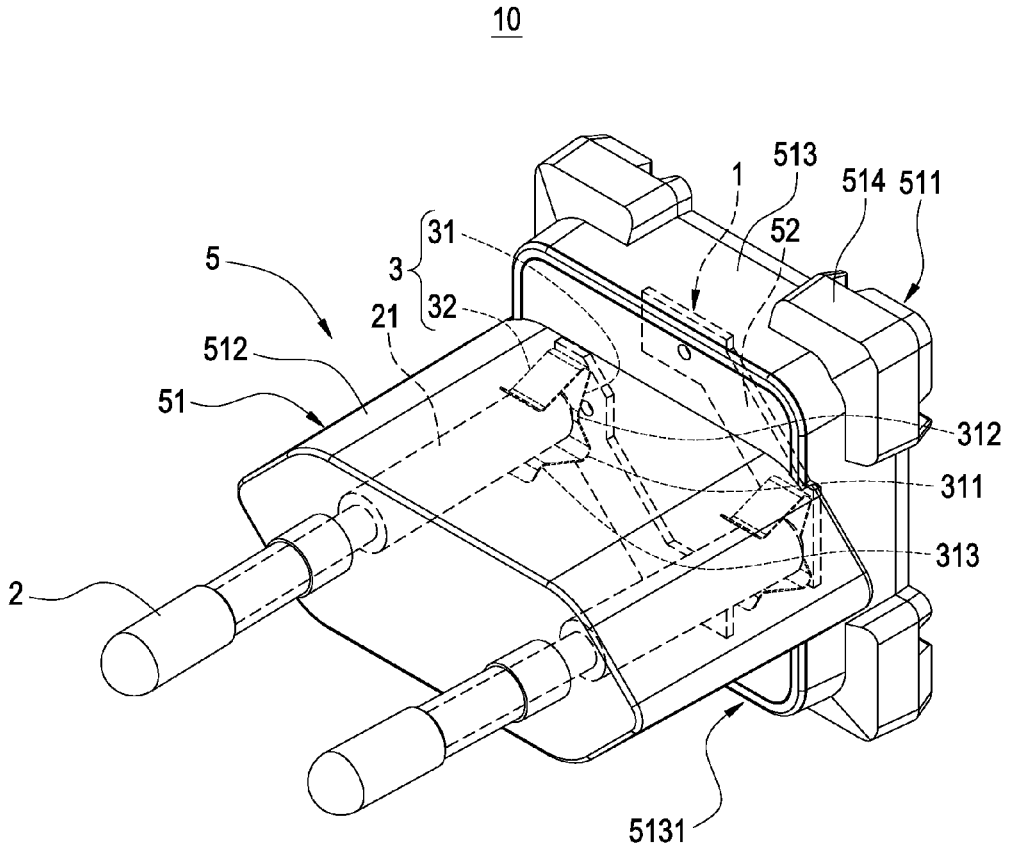
FIG. 3 is a perspective assembly view illustrating the plug structure according to the first embodiment of the present invention.
Figure 4:
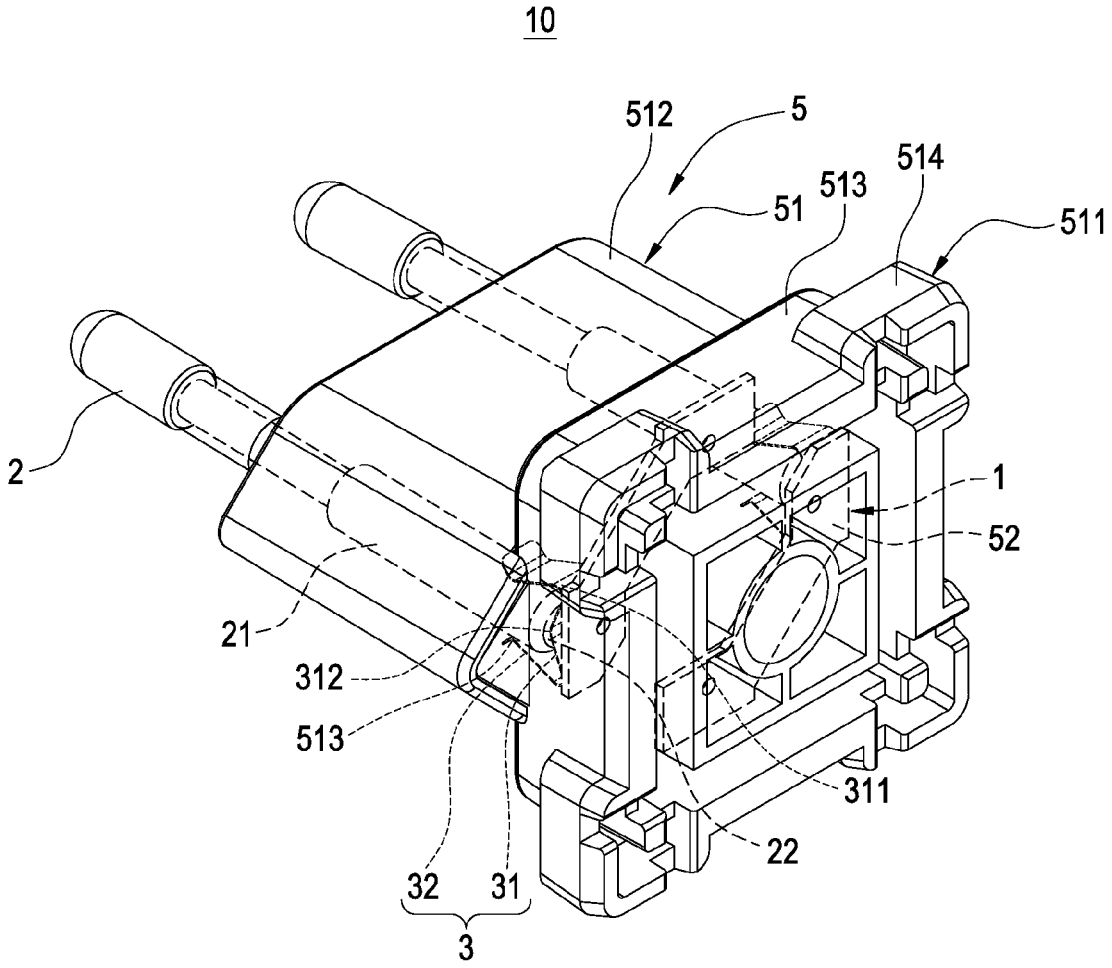
FIG. 4 is another perspective view diagram illustrating the plug structure according to the first embodiment of the present invention.

The detailed description and the technical contents of the present invention are illustrated with the accompanied drawings as follows. The accompanied drawings merely provide reference and description instead of a limit to the present invention.

Please refer to FIGS. 1-7. The present invention provides a power device and a plug structure thereof. The power device 100 primarily comprises a main body 4 and a plug structure 10. The plug structure 10 primarily comprises one or a plurality of electrical conductors 1, one or a plurality of pins 2 and one or a plurality of conductive elastic sheets 3.

Each of the plurality of pins 2 is correspondingly arranged to each of the electrical conductors 1. Each of the pins 2 has a conducting portion 21 and a distal end 22 formed on the conducting portion 21.

Each of the conductive elastic sheets 3 is disposed between each of the pins 2 and each of the electrical conductors 1, respectively. Each of the conductive elastic sheets 3 has a lateral segment 31 and at least one longitudinal segment 32 extending from the lateral segment 31. The lateral segment 31 has a first convex portion 311 and a second convex portion 312 reversed from each other. The longitudinal segment 32 has a third convex portion 321. The lateral segment 31 is clamped between the distal end 22 and the electrical conductor 1. The first convex portion 311 contacts the electrical conductor 1. The second convex portion 312 contacts the distal end 22. The third convex portion 321 contacts the conducting portion 21.

Substantially, the first convex portion 311 bends between the longitudinal segments 32 and forms a first opening 3111 with a first angle θ1 towards the pin 2. The second convex portion 312 bends on the lateral segment 31 and forms a second opening 3121 with a second angle θ2 towards the electrical conductor 1. The third convex portion 321 bends on the longitudinal segment 32 and forms a third opening 3211 with a third angle θ3 towards the pin 2.

In addition, there are two longitudinal segments 32, such that the lateral segment 31 is of w-shaped, each of the longitudinal segments 32 is of v-shaped, and each of the conductive elastic sheets 3 is of a butterfly shape.

Also, there are two longitudinal segments 32, the two longitudinal segments 32 are formed on two ends of the lateral segment 31, respectively, and the conductive elastic sheet 3 grasps the conducting portion 21 via the two third convex portions 321.

The power device 100 primarily comprises a main body 4 and the above-mentioned plug structure 10. The main body 4 includes a housing 41 and a circuit board 42 accommodated in an inside of the housing 41. The plug structure 10 is connected to the housing 41. Each of the electrical conductors 1 is electrically connected to the circuit board 42.

The detailed description is as follows. FIGS. 1-6 illustrate the power device 100 and the plug structure 10 of a first embodiment of the present invention. Specifically, the plug structure 10 is a replaceable plug 5. The replaceable plug 5 further includes a plug base 51. The plug base 51 has a butting segment 511. Each of the electrical conductors 1 is a conductive sheet 52. Each of the conductive sheets 52 is fixed and exposed to the plug base 51. In other words, the lateral segment 31 is clamped between the distal end 22 and the conductive sheet 52. The first convex portion 311 contacts the conductive sheet 52. In addition, each of the pins 2 and each of the conductive elastic sheets 3 are fixed to the plug base 51.

Also, the main body 4 further includes a plurality of metal elastic sheets 43. Each of the metal elastic sheets 43 is electrically connected to the circuit board 42 and exposed to the housing 41. The housing 41 has an assembling section 411. The assembling section 411 and the butting segment 511 are assembled with each other, such that each of the metal elastic sheets 43 and each of the conductive sheets 52 contact with each other.

The further description is as follows. The plug base 51 includes a first base body 512 and a second base body 513 fixed with each other. Two ends of the first base body 512 have a plurality of first penetration slots 5121 and a second penetration slot 5122 communicated with each other, respectively. Each of the pins 2 is inserted in and positioned on each of the first penetration slots 5121. Each of the conducting portions 21 is exposed to the second penetration slot 5122. Two ends of second housing 513 have a fixing segment 5131 and the butting segment 511, respectively. The fixing segment 5131 is used to be butted to the first base body 512 with each other. A plurality of convex blocks 5132 extend from the fixing segment 5131. Each of the convex blocks 5132 has a through slot 5133. Each of the through slots 5133 forms an end edge 5134 away from an internal periphery of the first base body 512. Each of the conductive sheets 52 is locked and positioned on each of the end edges 5134. Each of the conductive elastic sheets 3 is accommodated in each of the through slots 5133. Each of the convex blocks 5132 is inserted in each of the second penetration slots 5122, such that each of the conducting portions 21 is accommodated in each of the through slots 5133.

Further, a wing block 5123 extends from an end portion of an external periphery of the first base body 512. The fixing segment 5131 has a recess portion 5135. The wing block 5123 is connected to the recess portion 5135 via an ultrasonic welding method, such that the first base body 512 and the second base body 513 are assembled with each other via the ultrasonic welding method. The way of assembling the first base body 512 and the second base body 513 can be adjusted case by case, but not limited to the embodiment.

In addition, the housing 41 has a plurality of ports 412 and a u-shaped locking block 413 extending with respect to a surrounding of each of the ports 412. Each of the metal elastic sheets 43 is fixed to the circuit board 42 and exposed to each of the ports 412. A track is formed on an internal periphery of the u-shaped locking block 413 and further forms the assembling section 411. A plurality of sliding blocks 514 protrude from an external periphery of the plug base 51 so as to form the butting segment 511. Each of the sliding block 514 slides in an inside of the u-shaped locking block 413 via an opening of the u-shaped locking block 413. And, each of the sliding blocks 514 is locked and limited to the u-shaped locking block 413, such that the replaceable plug 5 is replaceably connected to the main body 4.

FIGS. 2-5 illustrate the plug structure 10 of the present invention. The pin 2 is correspondingly arranged to the electrical conductor 1. The pin 2 has the conducting portion 21 and the distal end 22 formed on the conducting portion 21. The conductive elastic sheet 3 is disposed between the pin 2 and the electrical conductor 1, respectively. Each of the conductive elastic sheets 3 has the lateral segment 31 and the at least one longitudinal segment 32 extending from the lateral segment 31. The lateral segment 31 has the first convex portion 311 and the second convex portion 312 reversed from each other. The longitudinal segment 32 has the third convex portion 321. Specifically, the lateral segment 31 is clamped between the distal end 22 and the electrical conductor 1. The first convex portion 311 contacts the electrical conductor 1. The second convex portion 312 contacts the distal end 22. The third convex portion 321 contacts the conducting portion 21. Accordingly, compared with the requirement for connecting the pin and the electrical conductor of the plug structure by riveting or welding method according to the prior art, the present invention disposes the conductive elastic sheet 3 between the pin 2 and the electrical conductor 1 so as to form electrically connection between the pin 2 and the electrical conductor 1. Because the conductive elastic sheet 3 provides a plurality of convex portions for contacting the pin 2 and the electrical conductor 1, so as to delete the riveting or welding process, such that defective products can be avoid by reducing variation of riveting size or tin-feeding quality during the riveting or welding process. Further, it can solve the problem of inconvenient assembly of the riveting or welding portion of the plug structure, so as to achieve simple assembly, low cost, perfect quality and convenience maintenance.

Furthermore, the first convex portion 311 bends between the longitudinal segments 32 and forms the first opening 3111 with the first angle θ1 towards the pin 2. The second convex portion 312 bends on the lateral segment 31 and forms the second opening 3121 with the second angle θ2 towards the electrical conductor 1. The third convex portion 321 bends on the longitudinal segment 32 and forms the third opening 3211 with the third angle θ3 towards the pin 2. Accordingly, each of the convex portions (i.e., the first convex portion 311, the second convex portion 312 and the third convex portion 321) formed on the conductive elastic sheet 3 has flexibility, such that in response to the difference of the size or the location of various types of pins 2, each of the convex portions can be deformed to contact the pin 2. Therefore, the conductive elastic sheet 3 of the present invention has a wild range of well assembly performance, so as to render the convenient assembly of the plug structure 10.

Moreover, there are two longitudinal segments 32. The two longitudinal segments 32 are formed on two ends of the lateral segment 31, respectively. The conductive elastic sheet 3 grasps the conducting portion 21 via the two third convex portions 321, such that the conductive elastic sheet 3 forms a u-shaped grasping sheet so as to be grasped in the pin 2. Therefore, the conductive elastic sheet 3 can be grasped in the pin 2 by itself without external force, so as to improve the assembly stability of the plug structure 10.

Figure 6:
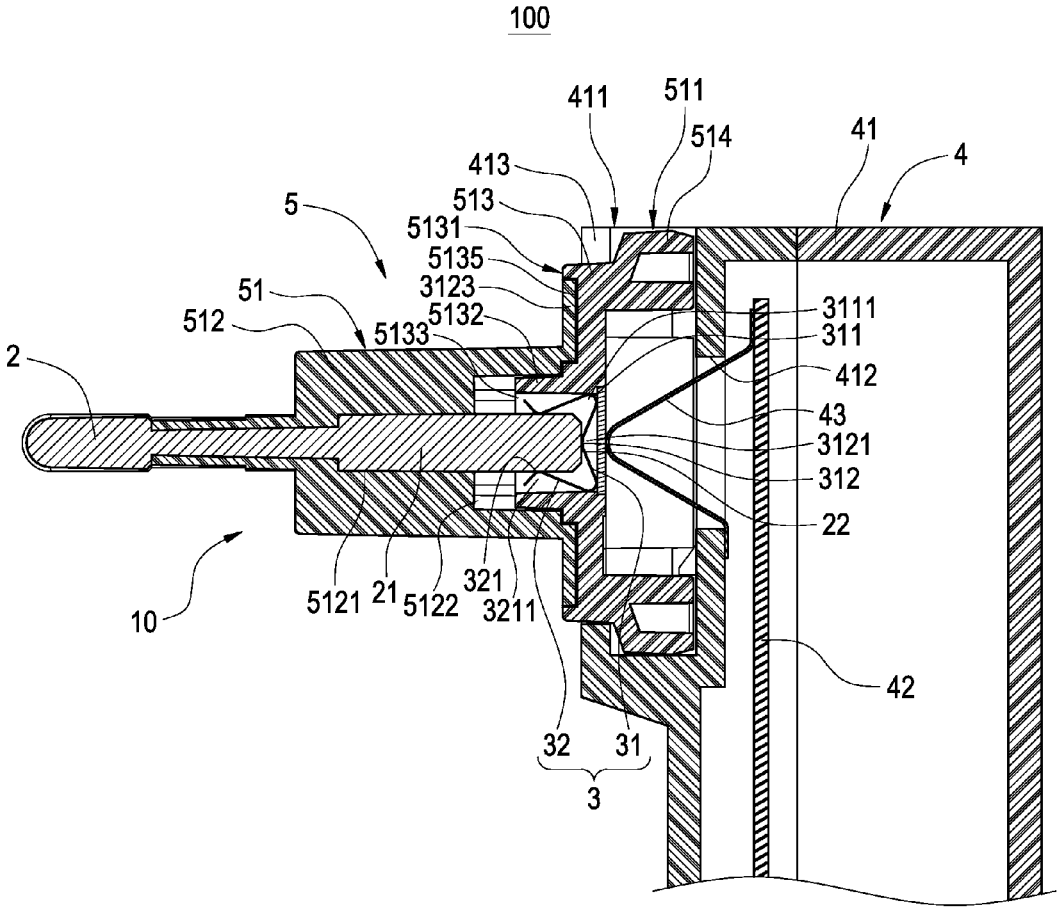
FIG. 6 is a schematic assembly view illustrating the plug structure according to the first embodiment of the present invention.

FIG. 6 illustrates the power device 100 of the present invention. The main body 4 includes the housing 41 and the circuit board 42 accommodated in an inside of the housing 41. The plug structure 10 is connected to the housing 41. Each of the electrical conductors 1 is electrically connected to the circuit board 42. Each of the pins 2 is correspondingly arranged to each of the electrical conductors 1. Each of the pins 2 has the conducting portion 21 and the distal end 22 formed on the conducting portion 21. Each of the conductive elastic sheets 3 is disposed between each of the pins 2 and each of the electrical conductors 1, respectively. Each of the conductive elastic sheets 3 has the lateral segment 31 and the longitudinal segment 32 extending from the lateral segment 31. The lateral segment 31 has the first convex portion 311 and the second convex portion 312 reversed from each other. The longitudinal segment 32 has the third convex portion 321. Substantially, the lateral segment 31 is clamped between the distal end 22 and the electrical conductor 1. The first convex portion 311 contacts the electrical conductor 1. The second convex portion 312 contacts the distal end 22. The third convex portion 321 contacts the conducting portion 21. Accordingly, it applies the advantages of the conductive elastic sheet 3 either on the plug structure 10 or the power device 100, so as to achieve the above-mentioned function and effect.

In addition, the plug structure 10 is a replaceable plug 5, such that the power device 100 can further change different types of pins 2, so as to be use in sockets in different countries.

Also, the sliding block 514 protrudes from an external periphery of the plug base 51 of the replaceable plug 5. The u-locking block 413 extends from the housing 41. And, the track is formed on an internal periphery of the u-shaped locking block 413, such that the plug base 51 slides in an inside of the u-shaped locking block 413 via the sliding block 514. And, the plug base 51 is locked and limited in the u-shaped locking block 413 via the sliding block 514, so as to render the convenient connection of the replaceable plug 5 and the main body 4.

Figure 7:
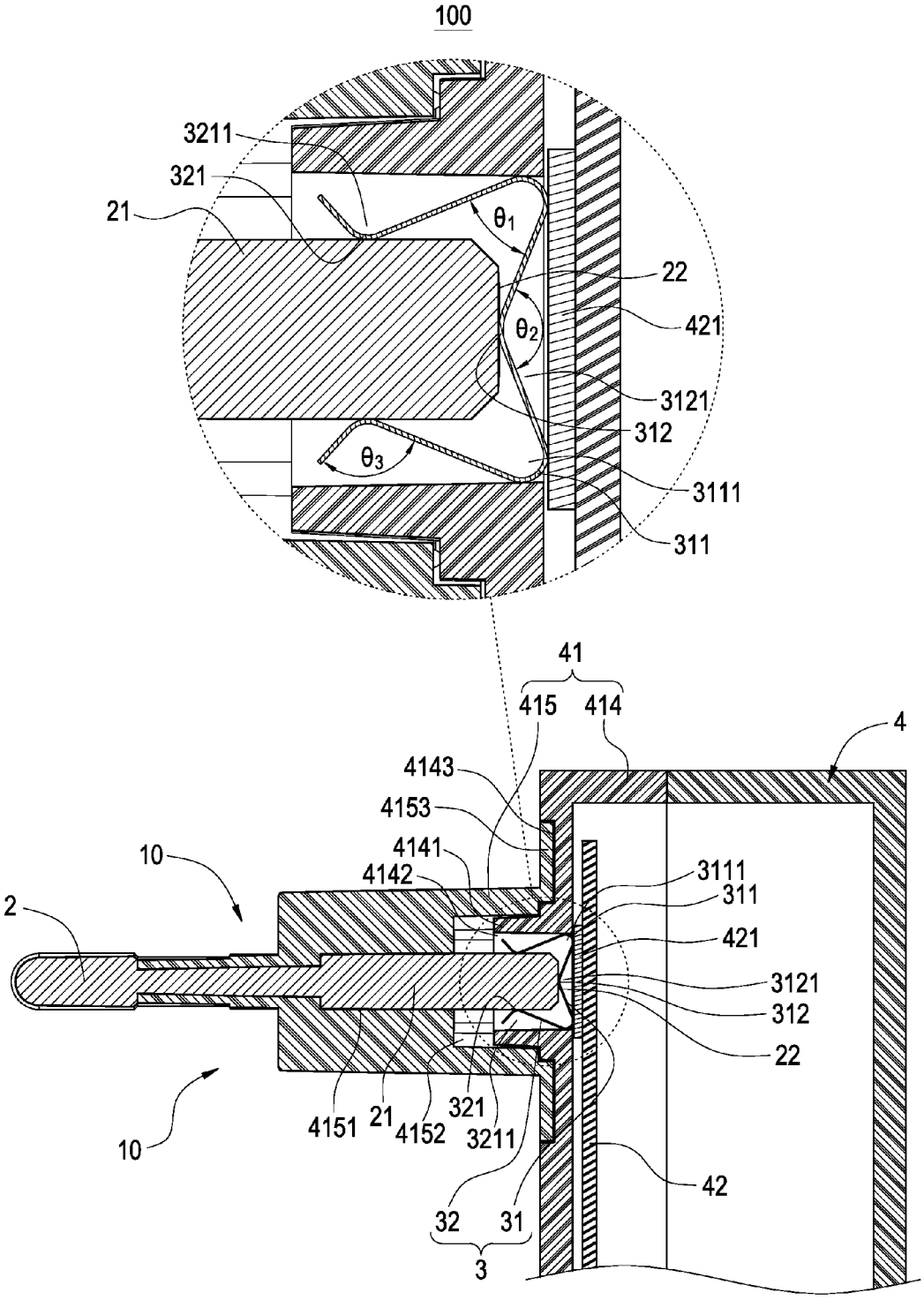
FIG. 7 is a schematic sectional view illustrating the power device according to a second embodiment of the present invention.

FIG. 7 illustrates a second embodiment of the power device 100 and the plug structure 10 of the present invention. Substantially, the plug structure 10 is a stationary plug 6. Each of the electrical conductors 1 is each of the circuits 421 formed on the circuit board 42. In other words, the lateral segment 31 is clamped between the distal end 22 and the circuit board 42.

The first convex portion 311 contacts the circuit 421. Each of the pins 2 and each of the conductive elastic sheets 3 are fixed to the housing 41.

A further description is as follows. The housing 41 includes a first housing 414 and a second housing 415. The circuit board 42 is accommodated in an inside of the first housing 414. A plurality of protrusion blocks 4141 extend from the first housing 414. Each of the protrusion blocks 4141 has a perforation slot 4142. Each of the conductive portions 421 is correspondingly arranged to each of the perforation slots 4142. Each of the conductive elastic sheets 3 is accommodated in each of the perforation slots 4142. Two ends of the second housing 415 have a plurality of first accommodation slots 4151 and a second accommodation slots 4152 communicated with each other, respectively. Each of the pins 2 is inserted and positioned on each of the first accommodation slots 4151. Each of the conducting portions 21 is exposed to the second accommodation slot 4152. Each of the protrusion blocks 4141 is inserted in each of the second accommodation slots 4152, such that each of the conducting portions 21 is accommodated in each of the perforation slots 4142. Accordingly, it applies the advantages of the conductive elastic sheet 3 either on the plug structure 10 or the power device 100, so as to achieve the above-mentioned function and effect.

In addition, a wing portion 4153 extends from an end portion of an external periphery of the second housing 415. The first housing 414 has a concave portion 4143. The wing portion 4153 is connected to the concave portion 4143 via an ultrasonic welding method, such that the first housing 414 and the second housing 415 are assembled with each other via the ultrasonic welding method. The way of assembling the first housing 414 and the second housing 415 can be adjusted case by case, but not limited to the embodiment.

Figure 5:
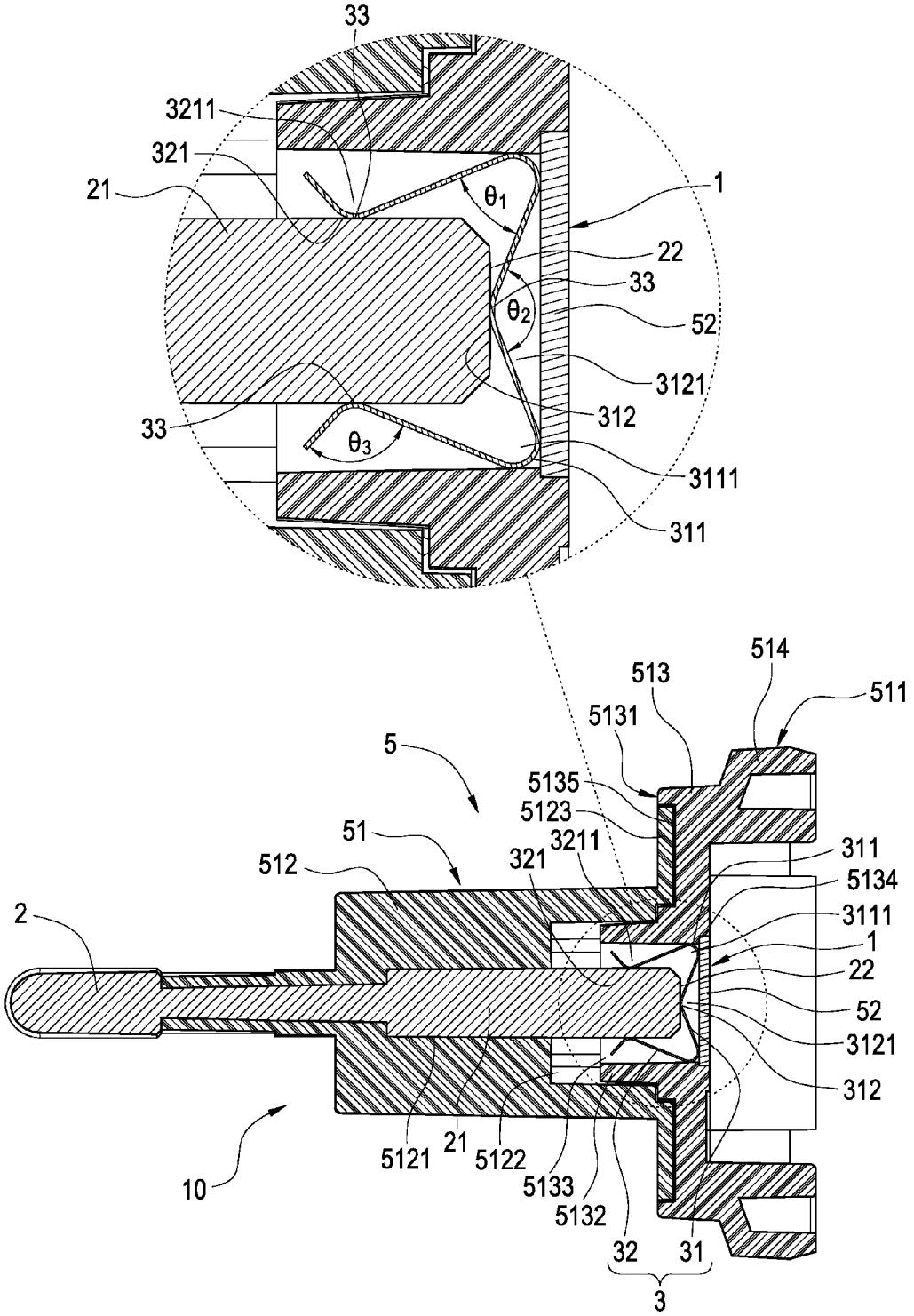
FIG. 5 is a schematic sectional view illustrating the plug structure according to the first embodiment of the present invention.

In addition, as illustrated in FIG. 5, there are three conducting points 33 between the conductive elastic sheet 3 and the conducting portion 21, such that each of the electrical conductors 1 and each of the pins 2 achieve electrical connection via each of the conducting points 33. Specifically, the second convex portion 312 and the two third convex portions 321 contact the conducting portion 21 so as to form each of the conducting points 33, such that more conducting points are formed between the electrical conductor 1 and each of the pins 2 for further improve conducting stability of the plug structure 10.

In conclusion, the power device and the plug structure thereof according to the present invention indeed achieve the purpose and thus solves the defect of the prior art. Further, it totally complies with requirements for the application of a Utility Model patent extremely based on the industrial applicability, novelty and non-obviousness thereof such that an application is filed pursuant to the Patent Law. Applicant respectfully requests an examination for the application so as to protect the invention of the inventor.

What is claimed is:

1. A plug structure, comprising:

an electrical conductor;

a pin arranged to the electrical conductor, having a conducting portion and a distal end formed on the conducting portion; and a conductive elastic sheet disposed between the pin and the electrical conductor, having a lateral segment and at least one longitudinal segment extending from the lateral segment, the lateral segment having a first convex portion and a second convex portion reversed from each other, the longitudinal segment having a third convex portion;

wherein, the lateral segment is clamped between the distal end and the electrical conductor, the first convex portion contacts the electrical conductor, the second convex portion contacts the distal end, and the third convex portion contacts the conducting portion.

2. The plug structure according to claim 1, wherein the first convex portion bends between the lateral segment and the longitudinal segment and forms a first opening with a first angle towards the pin, the second convex portion bends on the lateral segment and forms a second opening with a second angle towards the electrical conductor, and the third convex portion bends on the longitudinal segment and forms a third opening with a third angle towards the pin.

3. The plug structure according to claim 2, wherein there are two longitudinal segments, such that the lateral segment is of W-shaped, and the longitudinal segment is of V-shaped.

4. The plug structure according to claim 1, wherein there are two longitudinal segments formed on two ends of the lateral segment, respectively, and the conductive elastic sheet grasps the conducting portion via two third convex portions.

5. A power device, comprising:

a main body including a housing and a circuit board accommodating in an inside of the housing; and a plug structure connected to the housing, the plug structure including:

an electrical conductor;

a pin arranged to the electrical conductor, having a conducting portion and a distal end formed on the conducting portion; and a conductive elastic sheet disposed between the pin and the electrical conductor, having a lateral segment and at least one longitudinal segment extending from the lateral segment, the lateral segment having a first convex portion and a second convex portion reversed from each other, the longitudinal segment having a third convex portion;

wherein, the lateral segment is clamped between the distal end and the electrical conductor, the first convex portion contacts the electrical conductor, the second convex portion contacts the distal end, and the third convex portion contacts the conducting portion.

6. The power device according to claim 5, wherein the first convex portion bends between the lateral segment and the longitudinal segment and forms a first opening with a first angle towards the pin, the second convex portion bends on the lateral segment and forms a second opening with a second angle towards the electrical conductor, and the third convex portion bends on the longitudinal segment and forms a third opening with a third angle towards the pin.

7. The power device according to claim 6, wherein there are two longitudinal segments, such that the lateral segment is of W-shaped, and the longitudinal segment is of V-shaped.

8. The power device according to claim 5, wherein there are two longitudinal segments formed on two ends of the lateral segment, and the conductive elastic sheet grasps the conducting portion via two third convex portions.

9. The power device according to claim 5, wherein the plug structure is a replaceable plug including a plug base, the plug base has a butting segment, the electrical conductor is a conductive sheet fixed to and exposed to the plug base, the pin and the conductive elastic sheet are fixed to the plug base, the main body further includes a plurality of metal elastic sheets, the metal elastic sheet is electrically connected to the circuit board and exposed to the housing, the housing has a assembling section, and the assembling section and the butting segment are assembled with each other, such that the metal elastic sheet and the conductive sheet contact with each other.

10. The power device according to claim 9, wherein the plug base includes a first base body and a second base body fixed with each other, two ends of the first base body have a first penetration slot and a second penetration slot communicated with each other, the pin is inserted positioned in the first penetration slot, the conducting portion is exposed to the second penetration slot, two ends of the second housing have a fixing segment and the butting segment, respectively, a convex block is extended from the fixing segment, the convex block has a through slot, the through slot forms an end edge away from an internal periphery of the first base body, the conductive sheet is locked to and positioned on the end edges, the conductive elastic sheet is accommodated in the through slot, and the convex block is inserted in the second penetration slot, such that the conducting portion is accommodated in the through slot.

11. The power device according to claim 10, wherein a wing block extends from an end portion of an external periphery of the first base body, the fixing segment has a recess portion, and the wing block is connected to the recess portion via an ultrasonic welding method.

12. The power device according to claim 9, wherein the housing has a plurality of ports and a U-shaped locking block extending with respect to surroundings of the ports, the metal elastic sheet is fixed to the circuit board and exposed to the port, the U-shaped locking block forms the assembling section, a plurality of sliding blocks protrude from an external periphery of the plug base so as to form the butting segments, and the sliding blocks slide and are locked to the U-shaped locking block.

13. The power device according to claim 5, wherein the plug structure is a stationary plug, the electrical conductors are a plurality of circuits formed on the circuit board, and the pin and the conductive elastic sheet are fixed to the housing.

14. The power device according to claim 13, wherein the housing includes a first housing and a second housing, the circuit board is accommodated in an inside of the first housing, a plurality of protrusion blocks extend from the first housing, the protrusion block has a perforation slot, the conductive portion is correspondingly arranged to the perforation slot, the conductive elastic sheet is accommodated in the perforation slot, two ends of the second housing have a plurality of first accommodation slots and a second accommodation slot communicated with each other, respectively, the pin is inserted in and positioned on the first accommodation slot, the conducting portion is exposed to the second accommodation slot, and the protrusion block is inserted in each of the second accommodation slots, such that the conducting portion is accommodated in the perforation slot.

15. The power device according to claim 14, wherein a wing portion extends from an end portion of an external periphery of the second housing, the first housing has a concave portion, and the wing portion is connected to the concave portion via an ultrasonic welding method.

16. A plug structure, comprising:

an electrical conductor;

a pin correspondingly arranged to the electrical conductor, having a conducting portion and a distal end formed on the conducting portion; and a conductive elastic sheet disposed between the pin and the electrical conductor, having a lateral segment and two longitudinal segments extending from the lateral segment;

wherein, the lateral segment is clamped between the distal end and the electrical conductor, the two longitudinal segments are grasped to two sides of the conducting portion, and three conducting points are formed between the conductive elastic sheet and the conducting portion, such that each of the electrical conductors and each of the pins achieve electrical connection via the conducting points.

17. The plug structure according to claim 16, wherein the lateral segment has a first convex portion and a second convex portion reversed from each other, the longitudinal segment has a third convex portion, the first convex portion contacts the electrical conductor, the second convex portion contacts the distal end, and the third convex portion contacts the conducting portion.

18. The plug structure according to claim 17, wherein the second convex portion and the two third convex portions contact the conducting portion so as to form the conducting point.

19. The plug structure according to claim 17, wherein the first convex portion bends between the lateral segment and the longitudinal segment and forms a first opening with a first angle towards the pin, the second convex portion bends on the lateral segment and forms a second opening with a second angle towards the electrical conductor, and the third convex portion bends on the longitudinal segment and forms a third opening with a third angle towards the pin.

20. The plug structure according to claim 19, wherein the lateral segment is of W-shaped, and the longitudinal segment is of V-shaped.

* * * * *